US011047095B2

(12) United States Patent
Engels

(10) Patent No.: US 11,047,095 B2
(45) Date of Patent: Jun. 29, 2021

(54) VARIABLE HEIGHT OFFSET MOLD

(71) Applicant: Wirtgen GmbH, Windhagen (DE)

(72) Inventor: Michael Engels, Obererbach (DE)

(73) Assignee: Wirtgen GmbH

( * ) Notice: Subject to any disclaimer, the term of this patent is extended or adjusted under 35 U.S.C. 154(b) by 130 days.

(21) Appl. No.: 16/235,083

(22) Filed: Dec. 28, 2018

(65) Prior Publication Data

US 2020/0208357 A1 Jul. 2, 2020

(51) Int. Cl.
*E01C 19/48* (2006.01)
*E01C 19/42* (2006.01)

(52) U.S. Cl.
CPC ..... *E01C 19/4886* (2013.01); *E01C 19/42* (2013.01)

(58) Field of Classification Search
CPC .... E01C 19/002; E01C 19/48; E01C 19/4853; E01C 19/4886; E01C 19/4893; E01C 19/502; E01C 19/506; E01C 19/52
USPC ..... 404/105; 280/6.154, 6, 155
See application file for complete search history.

(56) References Cited

U.S. PATENT DOCUMENTS 1,644,587 A * 10/1927 Heltzel ..... E01C 19/506 249/5
1,939,007 A * 12/1933 Heltzel ..... E01C 19/504 264/31
2,932,875 A 4/1960 Butcher
3,175,478 A * 3/1965 Smith ..... E01C 19/4893 404/105
3,362,308 A 1/1968 Austin et al.
3,600,773 A * 8/1971 Davis ..... E01C 19/4893 425/63
3,680,451 A 8/1972 Birtchet
3,749,504 A * 7/1973 Smith ..... B62D 55/116 404/84.2
3,749,505 A * 7/1973 Miller ..... B62D 55/116 404/98
3,792,133 A * 2/1974 Goughnour ..... E04G 11/34 264/33
3,797,958 A 3/1974 Lofaro
3,856,425 A * 12/1974 Miller ..... E01C 19/4893 404/84.2
3,915,583 A 1/1975 Aparicio
3,936,211 A 2/1976 Miller et al.
(Continued)

FOREIGN PATENT DOCUMENTS

BE 1017106 A3 2/2008
CA 2043773 A1 12/1992
(Continued)

OTHER PUBLICATIONS

Miller Formless printout from www.millerforless.com, 4 pages (undated but admitted to be prior art).
(Continued)

*Primary Examiner* — Thomas B Will
*Assistant Examiner* — Katherine J Chu
(74) *Attorney, Agent, or Firm* — Lucian Wayne Beavers; Patterson Intellectual Property Law, PC

(57) ABSTRACT

A slipform paving machine includes an offset mold, and a mold frame actuator which allows the height of the offset mold relative to the paving machine to be controlled. Internal actuators within the mold allow corresponding control of side form assemblies to control both height and profile of a resulting slipformed concrete structure.

20 Claims, 11 Drawing Sheets

(56) References Cited

U.S. PATENT DOCUMENTS 3,981,603 A * 9/1976 Sprunger ..... E01C 19/4893 404/98
4,013,375 A * 3/1977 Heaton ..... E01C 19/4893 404/98
4,014,633 A * 3/1977 Goughnour ..... E01C 19/4893 425/63
4,093,410 A 6/1978 Miller
4,266,917 A * 5/1981 Godbersen ..... E01C 19/4893 249/8
4,310,293 A * 1/1982 Eggleton ..... E01C 19/4893 404/100
4,319,859 A * 3/1982 Wise ..... E02B 5/02 404/96
4,384,806 A 5/1983 Taylor
4,668,462 A * 5/1987 Smith ..... B28B 7/10 249/157
4,789,266 A 12/1988 Clarke et al.
4,984,932 A * 1/1991 Leone ..... E01C 19/4893 404/72
5,051,025 A 9/1991 Taylor
5,101,360 A * 3/1992 Bennett ..... E01C 19/48 404/119
5,156,753 A * 10/1992 Speidel ..... B28B 7/02 249/159
5,352,063 A * 10/1994 Allen ..... E01C 19/008 404/102
5,533,888 A * 7/1996 Belarde ..... E01C 19/008 249/20
5,590,977 A * 1/1997 Guntert ..... B62D 55/065 404/101
5,662,431 A 9/1997 Colvard
5,997,270 A 12/1999 Labonte
6,109,825 A 8/2000 Yon
6,520,716 B2 * 2/2003 Rower ..... E01C 19/42 404/104
6,540,435 B1 * 4/2003 Lizarraga ..... E01C 19/4893 249/2
6,709,195 B2 3/2004 Piccoli et al.
6,817,849 B1 * 11/2004 Taylor ..... E01C 19/4893 404/105
6,923,453 B2 * 8/2005 Pivac ..... B60G 17/005 280/280
7,210,551 B2 * 5/2007 Krause ..... B60G 17/0165 180/282
7,377,719 B1 5/2008 Elizondo et al.
7,441,987 B1 10/2008 Sampey
7,624,995 B2 * 12/2009 Barbison ..... B60G 17/005 280/5.514
8,573,886 B1 * 11/2013 Taylor, Jr. ..... E01C 19/4893 404/105
8,920,070 B2 * 12/2014 Zimmermann ..... E01C 19/004 404/98
8,944,719 B2 * 2/2015 Frelich ..... E01C 19/48 404/84.1
9,163,366 B2 * 10/2015 Zimmermann ..... E01C 19/4886
9,228,300 B2 * 1/2016 Scattergood ..... E01C 19/008
9,309,632 B2 * 4/2016 Fritz ..... E01C 19/48
9,458,581 B1 * 10/2016 Schaeding ..... E02F 9/2041
9,631,329 B2 * 4/2017 Fritz ..... E01C 19/42
10,183,542 B1 * 1/2019 Bittner ..... B60G 17/0165
10,472,780 B1 * 11/2019 Wilson ..... E01C 19/405
10,474,338 B2 * 11/2019 Marsolek ..... G07C 5/0841
10,730,359 B2 * 8/2020 Bittner ..... B60G 21/067
2006/0198700 A1 * 9/2006 Maier ..... G01C 15/002 404/84.1
2015/0063907 A1 3/2015 Graham et al.
2016/0115654 A1 4/2016 Pedersen et al.
2016/0199998 A1 * 7/2016 Daul ..... E04G 13/00 249/2
2019/0177930 A1 * 6/2019 Ramb ..... E01C 23/01

FOREIGN PATENT DOCUMENTS

DE 19644397 A1 4/1997
DE 29612626 U1 12/1997
DE 19651865 A1 6/1998
DE 29924676 U1 11/2004
DE 19952697 B4 1/2006
EP 1197599 A2 4/2002
EP 1553227 A1 7/2005
FR 2765902 A1 1/1999

OTHER PUBLICATIONS

SLIP TEC printout from www.foutsfabrication.com (2013) 2 pages.
GOMACO Variable Barrier Mold Q&A (Aug. 2000) 4 pages.
Gomaco GT 3600 Slipform Paver catalog from http://www.gomaco.com/downloads/gt3600brochure.pdf, updated Aug. 2014, 24 pages.
European Search Report for corresponding EP 19 20 8435, dated Jun. 4, 2020, 11 pages (not prior art).

* cited by examiner

VARIABLE HEIGHT OFFSET MOLD

BACKGROUND OF THE INVENTION

1. Field of the Invention

The present invention relates generally to slipform paving machines, and more particularly to offset slipform paving machines using relatively large molds having a variable mold height and variable internal cross-section.

2. Description of the Prior Art

It is known to use relatively large variable height offset molds for paving or forming variable height concrete barriers adjacent a highway. These molds include at least one form insert that is variable in height relative to a mold frame, as well as two side plates to vary the lower portions of the profile of the mold form. These existing machines vary the profile height of the mold form through the use of the lifting columns which support the paving machine. In some instances, the variable height of the mold exceeds the available leg stroke of the lifting columns. This problem has previously been addressed by stopping the paving operation when a maximum leg stroke is reached, then unbolting the mold from the machine and re-bolting it to the paving machine in a different position so that the legs of the paving machine can be lowered, and paving can be resume. This procedure requires a great deal of manual work. Additionally, when the position of the mold relative to the machine frame is changed, the position of the feeding auger or belt relative to the machine frame must also be changed.

A further complication is that it is undesirable to use the entire leg stroke of the paving machine for purposes of adjusting mold height. This is because these relatively large molds are very heavy and thus if the legs are extended to their maximum height, the paving machine may be unstable. Accordingly, only a portion of the leg stroke may be used, and this can require further stages of unbolting and reattaching the mold to the machine frame.

These prior art devices have typically required that at least one ground-based operator walk alongside the mold and manually adjust the position of the left and right side form inserts and/or the left and right side plates. In some situations, two ground-based operators may be required, one walking along each side of the form.

These existing machines may control the height of the machine frame, and thus the height of the attached offset mold, by following a stringline reference which has been constructed along side the path where the concrete barrier is to be constructed. It is also known to utilize a second stringline reference to control an elevation of one of the form inserts of the offset mold.

Accordingly, there is a need for improved slipform paving machines designed to improve the use of large variable height offset molds.

SUMMARY OF THE INVENTION

In one embodiment a slipform paving machine includes a machine frame, and a plurality of ground engaging units for supporting the slipform paving machine from a ground surface. A plurality of height adjustable machine frame supports may support the machine frame from the plurality of ground engaging units. Each of the machine frames supports may include a machine frame support actuator configured to adjust a height of the machine frame relative to a respective one of the ground engaging units. Each of the machine frame supports may include a machine frame support sensor configured to provide a signal corresponding to the height of the machine frame relative to the respective one of the ground engaging units. The paving machine further includes an offset mold including a mold frame. A mold frame actuator may be configured to adjust a height of the mold frame relative to the machine frame. A mold frame sensor may be configured to provide a signal corresponding to the height of the mold frame relative to the machine frame. An external reference sensor may be provided and configured to provide a signal representative of a position of the slipform paving machine relative to an external reference system. The machine may include a controller configured to receive the signal from the external reference sensor, and to control extension of machine frame support actuators and the mold frame actuator to control a height of the mold frame relative to the ground surface.

A conveyor may be included and arranged to discharge material to be molded into the mold. A conveyor actuator may be configured to adjust a position of the conveyor relative to the machine frame. A conveyor sensor may be configured to provide a signal corresponding to the position of the conveyor relative to the machine frame.

In any of the above embodiments, the paving machine may further have the controller configured to control an extension of the conveyor actuator at least in part as a function of at least one of the signal from the mold frame sensor and the signal from at least one of the machine frame support sensors.

In any of the above embodiments, the slipform paving machine may further be configured such that the external reference sensor includes a stringline sensor. The controller may be configured to control extension of the machine frame support actuators and the mold frame actuator to control the height of the mold frame relative to the ground surface at least in part in response to a signal from the stringline sensor.

In any of the above embodiments, the paving machine may be further configured such that the external reference sensor is part of a three-dimensional guidance system, and the controller may be configured to control extension of the machine frame support actuators and the mold frame actuator to control the height of the mold frame relative to the ground surface at least in part in response to the signal from the external reference sensor.

In any of the above embodiments the slipform paving machine may have the height adjustable frame supports configured as lifting columns. The machine frame support actuators may include hydraulic piston-cylinder units located within their respective lifting columns. The machine frame support sensors may be integrated in their respective hydraulic piston-cylinder units. The mold frame actuator may include a hydraulic piston-cylinder unit, and the mold frame sensor may be integrated in the hydraulic piston-cylinder unit of the mold frame actuator.

In any of the above embodiments, the controller may be configured to control smaller changes in the height of the mold frame relative to the ground surface via the machine frame support actuators, and to control larger changes in the height of the mold frame relative to the ground surface via the mold frame actuator.

In any of the above embodiments the mold may further include a first side form assembly and a second side form assembly. The first side form assembly may include a first form insert, a first form insert actuator configured to adjust the height of the first form insert relative to the mold frame, a first form insert sensor configured to provide a signal corresponding to the height of the first form insert relative to the mold frame, a first side plate, and a first side plate actuator configured to adjust a height of the first side plate. Similarly, the second side form assembly may include a second form insert, a second form insert actuator configured to adjust the height of the second form insert relative to the mold frame, a second form insert sensor configured to provide a signal corresponding to the height of the second form insert relative to the mold frame, a second side plate, and a second side plate actuator configured to adjust a height of the second side plate.

In any of the above embodiments the first side form assembly may further include a first side plate sensor configured to provide a signal corresponding to the height of the first side plate, and the second side form assembly may further include a second side plate sensor configured to provide a signal corresponding to the height of the second side plate.

In any of the above embodiments the controller may be further configured to control a change in position of at least one of the first form insert actuator and the first side plate actuator, and to control a change in position of at least one of the second form insert actuator and the second side plate actuator, in response to a change of height of the mold frame relative to the ground surface.

In any of the above embodiments the controller may be configured to provide for a mode of operation wherein for a given change in height of the mold frame relative to the ground surface, on one of the first side form assembly and the second side form assembly the respective form insert actuator position is fixed and the respective side plate actuator provides a corresponding change in position, and on the other of the first side form assembly and the second side form assembly the respective form insert actuator provides a corresponding change in position while the respective side plate actuator remains fixed.

In any of the above embodiments the controller may be configured to provide for a mode of operation wherein for a given change in height of the mold frame relative to the ground surface, on each of the first side form assembly and the second side form assembly the respective form insert actuator position is fixed and the respective side plate actuator provides a corresponding change in position.

In any of the above embodiments the controller may be configured to provide for a mode of operation wherein for a given change in height of the mold frame relative to the ground surface, on each of the first side form assembly and the second side form assembly the respective form insert actuator provides a corresponding change in position while the respective side plate actuator remains fixed.

In any of the above embodiments the controller may be configured such that for a given increase in height of the mold frame relative to the ground surface there is an equal increase in a combined downward extension of the first form insert and the first side plate relative to the mold frame, and there is an equal increase in a combined downward extension of the second form insert and the second side plate relative to the mold frame.

In any of the above embodiments each of the first form insert actuator and the second form insert actuator may include a hydraulic piston-cylinder unit, and each of the first form insert sensor and the second form insert sensor may be integrated in the hydraulic piston-cylinder unit of its respective actuator.

In any of the above embodiments the left first plate actuator may be configured to adjust a height of the first side plate relative to the first form insert, and the second side plate actuator may be configured to adjust a height of the second side plate relative to the second form insert.

In another embodiment of the invention a method is provided for operating a slipform paving machine. The paving machine may include a machine frame, a plurality of ground engaging units supporting the paving machine from a ground surface, and a plurality of height adjustable machine frame supports supporting the machine frame from the plurality of ground engaging units. Each of the machine frame supports may include a machine frame support actuator configured to adjust a height of the machine frame relative to a respective one of the ground engaging units. Each of the machine frame supports may include a machine frame support sensor configured to provide a signal corresponding to the height of the machine frame relative to the respective one of the ground engaging units. The machine may further include an offset mold including a mold frame, a mold frame actuator configured to adjust a height of a mold frame relative to the machine frame, and a mold frame sensor configured to provide a signal corresponding to the height of the mold frame relative to the machine frame. The machine may further include an external reference sensor configured to provide a signal representative of a position of the slipform paving machine relative to an external reference system.

The machine may further include a controller. The method may comprise the steps of:

(a) receiving in the controller the signal from the external reference sensors; and (b) controlling with the controller extension of the machine frame support actuators and the mold frame actuator to control a height of the mold frame relative to the ground surface.

The slipform paving machine may further include a conveyor arranged to discharge material to be molded into the mold, a conveyor actuator configured to adjust a position of the conveyor relative to the machine frame, and a conveyor sensor may be configured to provide a signal corresponding to the position of the conveyor relative to the machine frame, and the method may further include controlling with the controller, extension of conveyor actuator in response to changes in height of the mold frame relative to the ground surface, to maintain an upper end of the conveyor above an inlet of the mold.

In any of the above embodiments the mold may further include a first side form assembly and a second side form assembly. The first side form assembly may include a first form insert, a first form insert actuator configured to adjust the height of the first form insert relative to the mold frame, a first form insert sensor configured to provide a signal corresponding to the height of the first form insert relative to the mold frame, a first side plate, and a first side plate actuator configured to adjust a height of the first side plate. Similarly, the second side form assembly may include a second form insert, a second form insert actuator configured to adjust the height of the second form insert relative to the mold frame, a second form insert sensor configured to provide a signal corresponding to the height of the second form insert relative to the mold frame, a second side plate, and a second side plate actuator configured to adjust a height of the second side plate. The method may further include controlling with the controller, one or more of the actuators of each of the first and second side form assemblies so that extension of the side form assemblies corresponds to changes in height of the mold frame.

Numerous objects, features and advantages of the present invention will be readily apparent to those skilled in the art upon reading of the following disclosure when taken in conjunction with the accompanying drawings.

DETAILED DESCRIPTION

Figure 1:
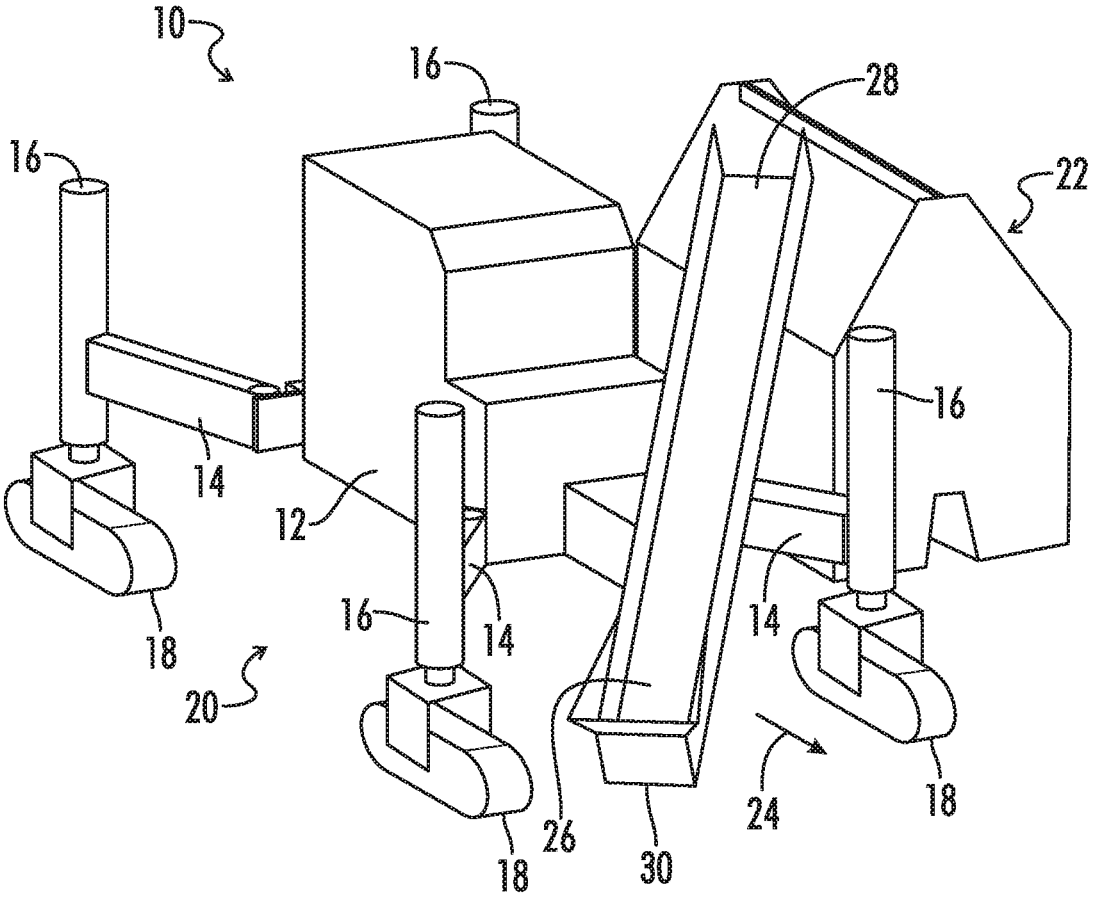
FIG. 1 is a front perspective view of a slipform paving machine including a large offset mold.

FIG. 1 shows a front perspective view of a slipform paving machine 10, which may for example be a Wirtgen model SP60 machine. The slipform paving machine 10 includes a machine frame 12 which in the illustrated embodiment includes four swing arms such as 14. A plurality of lifting columns 16 are attached to the machine frame 12 via the swing arms 14. A lower portion of each lifting column 16 has a crawler track 18 mounted thereon. The crawler tracks 18 may be referred to as ground engaging units 18 for supporting the slipform paving machine 10 from a ground surface 20. Alternatively, the ground engaging units may be wheels.

Each of the lifting columns 16 may be referred to as a height adjustable machine frame support 16 for supporting the machine frame 12 from one of the ground engaging units 18.

An offset mold 22 is supported from the machine 10. Mold 22 is of the type commonly referred to as a "large" offset mold. Such large offset molds may weigh on the order of 8 to 12 metric tons. This is contrasted to more conventional offset molds which typically have a weight on the order of 1-2 metric tons.

The direction of travel of the paving machine 10 in FIG. 1 is in the direction of the arrow 24, and thus with reference to the driver's viewpoint, in the illustrated embodiment of FIG. 1 the offset mold 22 is mounted on the left hand side of the machine frame 12. It will be appreciated that the mold 22 and the paving machine 10 are constructed so that the mold 22 may also be mounted on the right hand side of the machine frame 12 if desired.

A conveyor 26 is also mounted on the machine frame 12 and is arranged to discharge a material to be molded, such as concrete, from its upper end 28 into the mold 22. As will be understood by those skilled in the art, the conveyor 26 may be a belt type conveyor or alternatively it may be an auger type conveyor. A lower end 30 of the conveyor 26 will receive the material to be molded from a supply truck or the like and will convey that material upward to its upper end 28 and thus into the mold 22.

Figure 3:
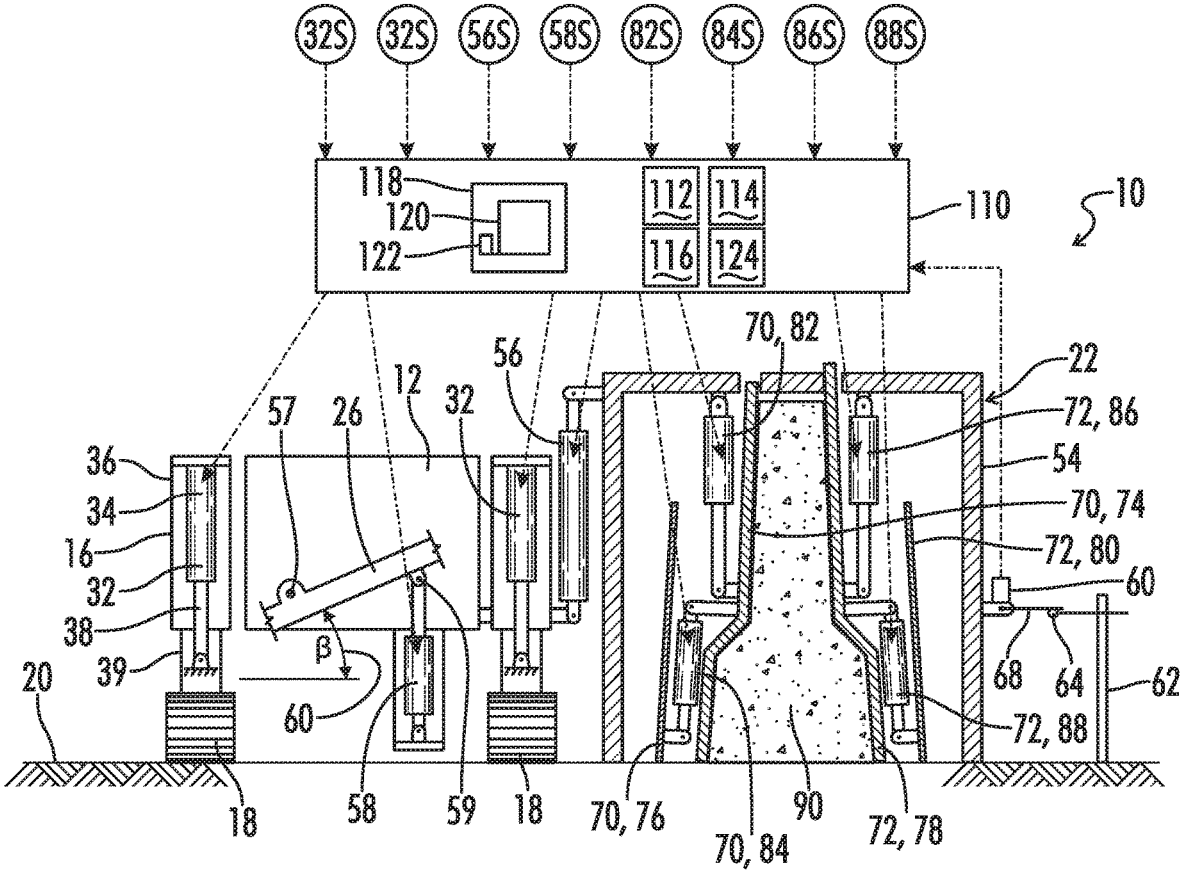
FIG. 3 is a schematic front elevation view of the paving machine as shown in FIG. 2A with a further addition of schematic illustration of the various actuators, and with a schematic illustration of the associated control system.

FIG. 3 is a schematic front elevation illustration of the slipform paving machine 10 of FIG. 1 further illustrating the internal components of the offset mold 22 and further illustrating the various actuators used to control the relative position of the various components of the slipform paving machine 10.

As seen in FIG. 3, each of the lifting columns or machine frame supports 16 includes a machine frame support actuator 32 configured to adjust a height of the machine frame 12 relative to a respective one of the ground engaging units 18. Each of the actuators 32 comprise a hydraulic piston-cylinder unit located within their respective lifting columns 16. As seen in FIG. 3, the machine frame support actuator 32 includes a cylinder portion 34 attached to an upper tubular portion 36 of the lifting column 16, and a piston portion 38 attached to a lower tubular portion 39 of the lifting column 16.

Figure 5:
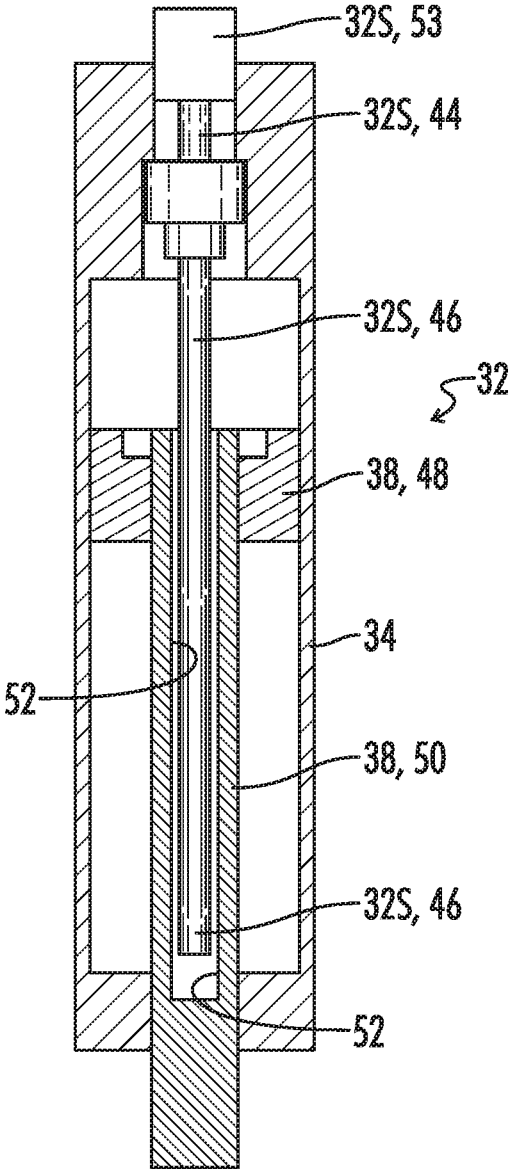
FIG. 5 is a schematic elevation cross section view of a typical hydraulic piston-cylinder unit including an integrated position sensor, which is representative of any of the actuators shown in FIG. 3.

FIG. 5 further schematically illustrates the internal construction of the actuator 32 and is also representative of the internal construction of the other actuators herein described. In the illustrated embodiment, the actuator 32 is of a type sometimes referred to as "smart cylinder" which includes an integrated sensor 32S configured to provide a signal corresponding to an extension of the piston member 38 relative to the cylinder member 34 of the actuator 32.

The sensor 32S includes a position sensor electronics housing 44 and a position sensor coil element 46.

The piston portion 38 of actuator 32 includes a piston 48 and a rod 50. The piston 48 and rod 50 have a bore 52 defined therein, within which is received the piston sensor coil element 46.

The actuator 32 is constructed such that a signal is provided at connector 53 representative of the position of the piston 48 relative to the position sensor coil element 46.

Such smart cylinders may operate on several different physical principles. Examples of such smart cylinders include but are not limited to magnetostrictive sensing, magnetoresistive sensing, resistive (potentiometric) sensing, Hall effect sensing, sensing using linear variable differential transformers, and sensing using linear variable inductance transducers.

FIG. 3 schematically illustrates the sensors associated with each of the actuators by the same number as used for the actuator with the addition of the suffix "S". Thus, each of the machine frame support actuators 32 include a sensor 32S.

The sensors 32S associated with the machine frame support actuators 32 may be referred to as machine frame support sensors 32S configured to provide a signal corresponding to the height of the machine frame 12 relative to the respective one of the ground engaging units 18. It will be appreciated that the sensor 32S does not need to directly measure the height of the machine frame relative to the ground engaging units, but instead the change in extension of the actuator 32 is an indirect indication of the height of the machine frame relative to the ground engaging units, because the same change occurs in the height of the machine frame relative to the ground engaging units as is measured in the extension of the actuator 32. Given the known dimensions and geometry of the other components of the paving machine 10 the desired height may be determined from the sensor signal.

Variable Height Offset Mold

As schematically illustrated in FIG. 3, the offset mold 22 includes a mold frame 54. A mold frame actuator 56 is connected between the mold frame 22 and the machine frame 12 and is configured to adjust a height of the mold frame 22 relative to the machine frame 12. A mold frame sensor 56S is configured to provide a signal corresponding to the height of the mold frame 54 relative to the machine frame 12. In the same manner as just described with reference to FIG. 5 for the actuator 32, the mold frame sensor 56S is preferably integrated in the mold frame actuator 56.

It will be appreciated that the mold frame sensor 56S does not need to directly measure the height of the mold frame relative to the machine frame, but instead the change in extension of the actuator 56 is an indirect indication of the height of the mold frame relative to the machine frame, because the same change occurs in the height of the mold frame relative to the machine frame as is measured in the extension of the actuator 56. Given the known dimensions and geometry of the other components of the paving machine 10 the desired height may be determined from the sensor signal.

As schematically illustrated in FIG. 3, the slipform paving machine 10 may further include a conveyor actuator 58 configured to adjust a position of the conveyor 26 relative to the machine frame 12. In the illustrated embodiment, changes in position of the conveyor 26 relative to machine frame 12 may result in a change of the slope angle 60 of the conveyor 26, such that its lower end portion 30 remains at substantially the same elevation relative to ground surface 20 and such that its upper end 28 is at a suitable elevation so as to discharge material into the upper end of the mold 22, regardless of the change in height of the mold 22 relative to the ground surface 20.

The conveyor actuator 58 may have a conveyor sensor 58S integrated therein as schematically represented in FIG. 3. The conveyor sensor 58S may be configured to provide a signal corresponding to the position of the conveyor 26 relative to the machine frame 12. In the same manner as just described with reference to FIG. 5 for the actuator 32, the conveyor sensor 58S is preferably integrated in the conveyor actuator 58.

It will be appreciated that the conveyor sensor 58S does not need to directly measure the position of the conveyor 26 relative to the machine frame 12, but instead the change in extension of the actuator 58 is an indirect indication of the position of the conveyor 26 relative to the machine frame 12, because the same change occurs in the height of the position of the conveyor 26 relative to the machine frame 12 at pivot point 59 as is measured in the extension of the actuator 58. Given the known dimensions and geometry of the other components of the paving machine 10 the desired position may be determined from the sensor signal.

The paving machine 10 may further include an external reference sensor 60 configured to provide a signal representative of a position of the slipform paving machine 10 relative to an external reference system 62. For example, the external reference system 62 may be comprised of a stringline 64 constructed on the ground surface 20 adjacent the location where it is desired to form the slipformed structure such as a barrier wall 90.

The external reference sensor 60 may take the form of a conventional wand type sensor arm 68 which engages and follows the stringline 64 as the slipform paving apparatus 10 moves along the ground parallel to the stringline 64. As will be understood by those skilled in the art, such stringline type external reference systems 62 may provide a reference suitable to guide the direction of the slipform paving machine 10 and also to control an elevation of the slipform paving machine 10 and thus of the attached offset mold 22.

The details of construction of the offset mold 22, in particular its internal components, are further schematically illustrated in the series of views designated as 2A-2F and in FIG. 3. In the series of views designated as 2A-2F the various actuators, such as lifting column leg actuators 32 and the mold frame actuator 56 previously identified are indicated by double headed arrows in the approximate position of the actuator and indicating the general direction of movement of the associated components provided by the actuator. In FIG. 3, schematic representations have been provided of the actual actuators in the form of hydraulic piston-cylinder units schematically showing the general physical connections between the actuator and the components to which it is connected.

As is seen in both FIGS. 2A-2F and FIG. 3, the mold 22 includes a first side form assembly 70 and a second side form assembly 72. With regard to the point of view of the viewer of FIGS. 2A-2F and FIG. 3, the first side form assembly 70 and second side form assembly 72 might be referred to as left and right side assemblies respectively. On the other hand, from the viewpoint of the operator of the paving machine 10 those left and right side designations might be reversed. In general, it will be understood that designations such as left and right side with regard to the side form assemblies are merely designations of convenience. This is particularly true when one considers that the mold 22 may be mounted either on left or right side of the paving machine 10. Thus, this further description will simply refer to first and second side form assemblies 70 and 72, and it will be understood that these could also be referred to as left and right side, or right and left side depending on the viewpoint of the viewer.

The first side form assembly 70 includes a first form insert 74 and a first side plate 76. The second side form assembly 72 includes a second form insert 78 and a second side plate 80.

The first side form assembly 70 further includes a first form insert actuator 82 configured to adjust the height of the first form insert 74 relative to the mold frame 54. The first form insert actuator 82 has integrally included therein a first form insert sensor 82S schematically illustrated in FIG. 3 and configured to provide a signal corresponding to the height of the first form insert 74 relative to the mold frame 54.

The first side form assembly 70 further includes a first side plate actuator 84 configured to adjust a height of the first side plate 76.

As seen in the embodiment of FIG. 3, the first side plate actuator 84 is connected between the first form insert 74 and the first side plate 76 and thus is configured to adjust the height of the first side plate 76 relative to the first form insert 74.

Figure 4:
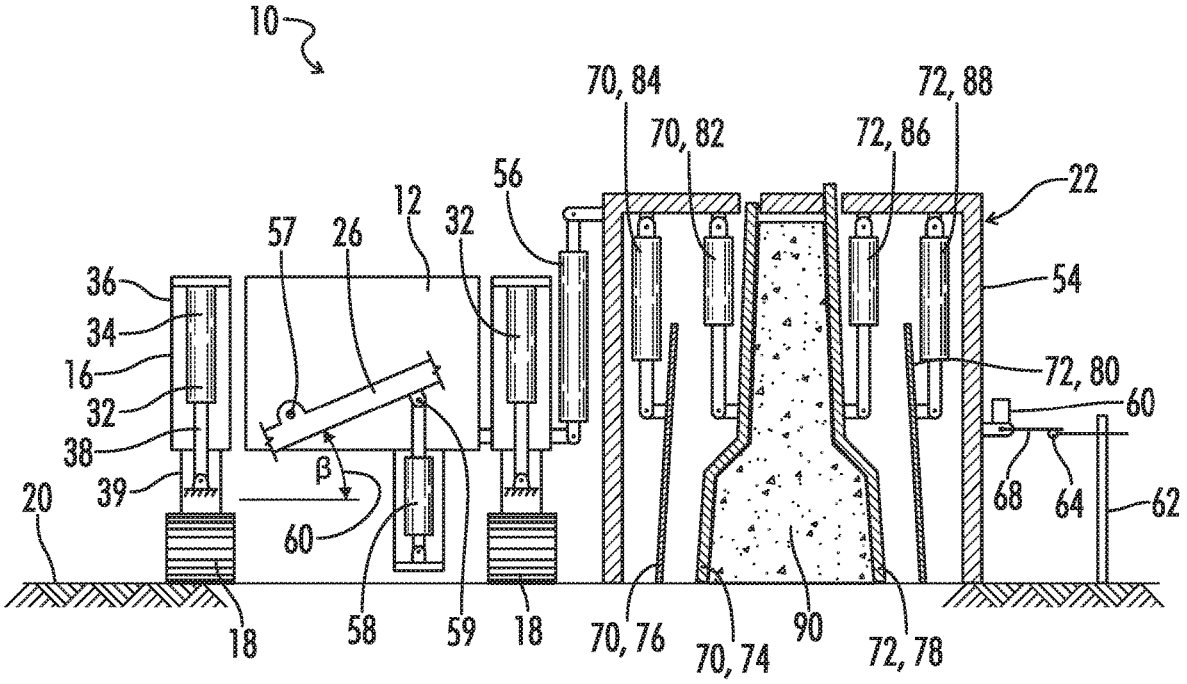
FIG. 4 is a schematic illustration similar to FIG. 3 showing an alternative arrangement of the left side plate actuator and the right side plate actuator.

However, in the alternative embodiment of FIG. 4, the first side plate actuator 84 is connected between the first side plate 76 and the mold frame 54 and is thus configured to adjust the height of the first side plate 76 relative to the mold frame 54.

The first side plate actuator 84 has integrally formed therein a first side plate sensor 84S which is schematically illustrated in FIG. 3 and which provides a signal corresponding to the height of the first side plate 76

Similarly, the second side form assembly 72 further includes a second form insert actuator 86 configured to adjust the height of the second form insert 78 relative to the mold frame 54. The second form insert actuator 86 has integrally formed therein a second form insert sensor 86S schematically illustrated in FIG. 3 and configured to provide a signal corresponding to the height of the second form insert 76 relative to the mold frame 54.

The second side form assembly 72 further includes a second side plate actuator 88 configured to adjust a height of the second side plate 80. In the embodiment of FIG. 3 the second side plate actuator 88 is connected between the second side plate 80 and the second form insert 78 and thus adjusts the height of the second side plate 80 relative to the second form insert 78. In the alternative embodiment of FIG. 4 the second side plate actuator 88 is connected between the second side plate 80 and the mold plate 54 and thus is configured to adjust the height of the second side plate 80 relative to the mold frame 54.

The second side plate actuator 88 has integrally formed there in a second side plate sensor 88S schematically illustrated in FIG. 3 and configured to provide a signal corresponding to the height of the second side plate 80.

Although in FIG. 3 only a single mold frame actuator 56 is shown, it will be understood that the mold frame actuator 56 will typically comprise a pair of spaced forward and rearward actuators connected between the machine frame 12 and the mold frame 54. Similarly, the first form insert actuator 82 will typically be one of a pair of a forward and rearward spaced form insert actuators. The same is true for the first side plate actuator 84, the second form insert actuator 86, and the second side plate actuator 88.

In addition to the alternative embodiment of FIG. 4, it is also possible to support the side plates directly from the mold frame 54, and to support the first form insert 74 from the first side plate 76, and to support the second form insert 78 from the second side plate 88.

In a further embodiment, the first side plate actuator 84 and the second side plate actuator 88 may not include sensors, or the first side plate actuator 84 and the second side plate actuator 88 may be operated in a "floating mode", such that instead of controlling the specific extension of the first side plate actuator 84 and the second side plate actuator 88, those actuators may be urged downwardly so that the bottom edges of first side plate 76 and the second side plate 80 slide along the ground 20.

Variable Height Concrete Divider Walls

Figure 6:
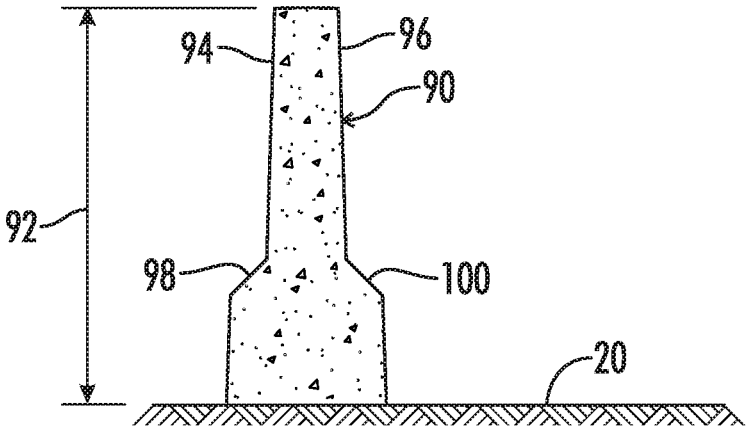
FIG. 6 is a schematic elevation view of a concrete divider wall formed by the paving machine of FIG. 1.

The offset mold 22 is particularly designed for the construction of concrete barrier walls to divide lanes of a highway which are flowing in opposite directions. The general shape of the barrier wall is shown in FIG. 3 and the barrier wall is designated as 90. The finished barrier wall 90 apart from the mold 22 is seen in FIG. 6. The barrier wall 90 may be described as having a height 92 above the ground surface. It will be understood that the ground surface may in fact be an underlying concrete slab which has been previously been poured. The barrier wall 90 has a first side profile 94 which is defined by the first side form assembly 70 and a second side profile 96 which is defined by the second side form assembly 72.

It is noted that the first side profile 94 includes a first step 98 and the second side profile 96 includes a step 100. As will be understood by those skilled in the art, for a typical barrier wall the height 92 may need to vary along the path of the highway, and the first and second side profiles 94 and 96 may vary in that the relative heights of their steps 98 and 100 relative to the ground surface 20 may also vary relative to each other.

Figure 7A:
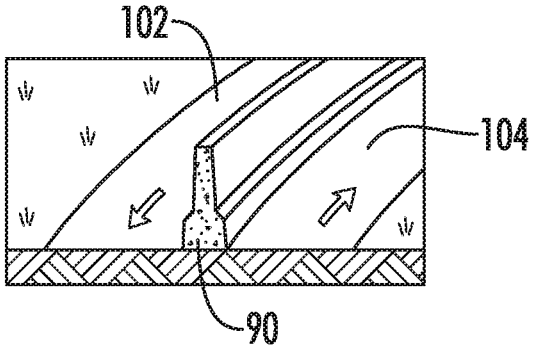
FIGS. 7A-7C illustrate several possible scenarios of varying road height on opposite sides of the barrier wall.
Figure 7B:
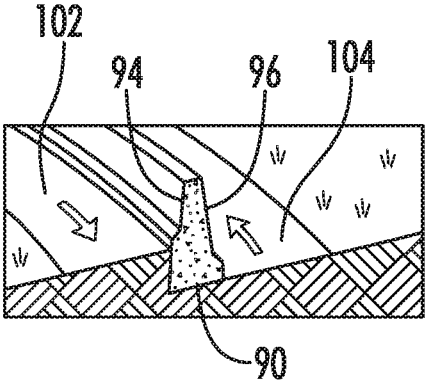
Figure 7C:
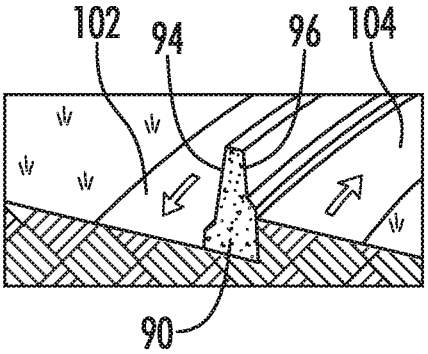

FIGS. 7A, 7B and 7C schematically illustrate several examples of variations in mold profile. In FIG. 7A, the barrier 90 is shown in a standard situation wherein two traffic lanes 102 and 104 are at the same level, and the barrier 90 has a symmetric left and right profile.

In the example of FIG. 7B, a left hand curve is shown where the traffic lanes are inclined to the left and the left side or first side barrier profile 94 is higher that the right side or second side barrier profile 94.

Then in FIG. 7C, a right curve is illustrated wherein the traffic lanes incline to the right, and the right or second side barrier profile 96 is higher than the left or first side barrier profile 94.

In addition to variations in the barrier profiles as shown in FIGS. 7B and 7C it may be necessary to change the height 92 of the barrier wall 90.

Control of Mold Height

The offset mold 22 disclosed herein is capable of automatically performing all these changes in the height and in the first and second side profiles of the molded barrier wall 90 through the use of a controller 110 which is schematically illustrated in FIG. 3. The controller 110 may be a part of the machine control system of paving machine 10, or it may be a separate control module. The controller 110 could be mounted as part of the offset mold 22.

The controller 110 receives input signals from the machine frame support sensors 32S, the mold frame sensor 56S, the conveyor sensor 58S, the first form insert sensor 82S, the first side plate sensor 84S, the second form insert sensor 86S, the second side plate sensor 88S and the external reference sensor 60 all as schematically illustrated in FIG. 3.

The controller 110 may also receive other signals indicative of various functions of the paving machine 10. The signals transmitted from the various sensors to the controller 110 are schematically indicated in FIG. 3 by phantom lines connecting the sensors to the controller with an arrowhead indicating the flow of the signal from the sensor to the controller.

Similarly, the controller 110 will generate command signals for controlling the operation of the various actuators, which command signals are indicated schematically in FIG. 3 by phantom lines connecting the controller to the various actuators with the arrow indicating the flow of the command signal from the controller 110 to the respective actuator. It will be understood that the various actuators as disclosed herein may be hydraulic piston-cylinder units and that the electronic control signal from the controller 110 will actually be received by a hydraulic control valve associated with the actuator and the hydraulic control valve will control the flow of hydraulic fluid to and from the hydraulic actuators to control the actuation thereof in response to the command signal from the controller 110.

Furthermore, the controller 110 may control the direction of travel of the slipform paving machine 10 by steering of the ground engaging units 18 via a conventional steering system (not shown). Communication of such steering signals from the controller 110 to the various steered ground engaging units is preformed in a conventional manner.

Controller 110 includes or may be associated with a processor 112, a computer readable medium 114, a data base 116 and an input/output module or control panel 118 having a display 120. An input/output device 122, such as a keyboard or other user interface, is provided so that the human operator may input instructions to the controller. It is understood that the controller 110 described herein may be a single controller having all of the described functionality, or it may include multiple controllers wherein the described functionality is distributed among the multiple controllers.

Various operations, steps or algorithms as described in connection with the controller 110 can be embodied directly in hardware, in a computer program product 124 such as a software module executed by the processor 112, or in a combination of the two. The computer program product 124 can reside in RAM memory, flash memory, ROM memory, EPROM memory, EEPROM memory, registers, hard disk, a removable disk, or any other form of computer-readable medium 114 known in the art. An exemplary computer-readable medium 114 can be coupled to the processor 112 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

With regard to controlling the operations of the offset mold 22, the control operations may generally be broken down into two categories. First, height of the mold 22 relative to the ground surface 20 and thus the height 92 of the resulting concrete barrier wall 90 is controlled by controlling the height of the machine frame 12 relative to the ground surface 20 via the actuators 32 within the lifting columns 16, and controlling the height of the mold 22 relative to the machine frame 12 via the mold frame actuator 56. The project plan will have determined that the barrier wall 90 should be located at a certain location on the earth's surface and that its height and side profiles should have varying specifications as the construction of the barrier wall proceeds along a predetermined path which is part of the project plan. Thus, the controller 110 will typically receive a signal from the external reference sensor 60, in response to which the controller 110 will control the extension of the machine frame support actuators 32 and the mold frame actuator 56 to control the height of the mold frame 54 relative to the ground surface 20 and thus control the resulting height 92 of the resulting molded barrier wall 90.

Thus, the controller 110 may be described as being configured to receive the signal from the external reference sensor 60 and to control extension of the machine frame support actuators 32 and the mold frame actuator 56 to control the height of the mold frame 54 relative to the ground surface 20.

Control of Extension of Internal Side Form Assemblies of the Offset Mold

The second aspect of the control provided by controller 110 is to control the actuation of the actuators 82, 84, 86, and 88 associated with the first and second side form assemblies 70 and 72 to accommodate changes in the height of the mold frame 54 relative to the ground surface 20, and to accommodate changes in the first and second side profiles 94 and 96 of the molded barrier wall 90. This control of the internal actuators of the mold 22 generally requires an extension of the overall height of the side form assemblies as the height of the mold 22 increases so the side form assemblies extend all the way downward to the ground surface 20. Additionally, the relative positions of the form inserts and the side plates may be modified to change the location of the steps 98 and 100 of the barrier wall relative to the ground surface.

It will be appreciated that for a given change in height of the mold frame 54 relative to the ground surface 20 there are a number of different combinations of actions of the actuators 82, 84, 86, and 88 associated with the interior components of the mold 22, which may be utilized to provide a corresponding change in the height of the first and second side form assemblies 70 and 72.

There are at least nine possible combinations of actions which may be utilized as shown in the following table and identified as modes 1-9.

| MODE | FIRST FORM INSERT ACTUATOR | FIRST SIDE PLATE ACTUATOR | SECOND FORM INSERT ACTUATOR | SECOND SIDE PLATE ACTUATOR |
|---|---|---|---|---|
| 1 | Variable | Fixed | Variable | Fixed |
| 2 | Variable | Fixed | Fixed | Variable |
| 3 | Fixed | Variable | Variable | Fixed |
| 4 | Fixed | Variable | Fixed | Variable |
| 5 | Variable | Variable | Variable | Fixed |
| 6 | Variable | Fixed | Variable | Variable |
| 7 | Variable | Variable | Fixed | Variable |
| 8 | Fixed | Variable | Variable | Variable |
| 9 | Variable | Variable | Variable | Variable |

Each of these modes of operation may be generally described as having the controller configured to control a change of position of at least one of the first form insert actuator 82 and the first side plate actuator 84, and to control a change in position of at least one of the second form insert actuator 86 and the second side plate actuator 88, in response to a change in height of the mold frame 54 relative to the ground surface 20.

Mode 1 from the table above may be described as having the controller 110 configured to provide for a mode of operation wherein for a given change in height of the mold frame 54 relative to the ground surface 20, on each of the first side form assembly 70 and the second side form assembly 72 the respective form insert actuator provides a corresponding change in position while the respective side plate actuator remains fixed.

Modes 2 and 3 from the table above are representative of another preferred control technique. Modes 2 and 3 may be generally described as having the controller 110 configured to provide for a mode of operation wherein for a given change in height of the mold frame 54 relative to the ground surface 20, on one of the first side form assembly 70 and the second side form assembly 72 the respective form insert actuator position is fixed and the respective side plate actuator provides a corresponding change in position, and on the other of the first side form assembly 70 and the second side form assembly 72 the respective form insert actuator provides a corresponding change of position while the respective side plate actuator remains fixed.

Another preferred control technique is that represented by mode 4, which may be described as having the controller 110 configured to provide for a mode of operation wherein for a given change in height of the mold frame 54 relative to the ground surface 20, on each of the first side form assembly 70 and the second side form assembly 72, the respective form insert actuator position is fixed and the respective side plate actuator provides a corresponding change in position.

It will be appreciated that each of the remaining modes of operations 5-9 provide more complex interactions of the movements of the various actuators wherein on at least one of the left and right side form assemblies 70 and 72 both associated actuators are varied in order to achieve the desired overall extension of the side form assembly and to provide the appropriate change in location of the associated step on the resulting formed concrete barrier wall.

In another embodiment of the invention, preferred modes of operation may be selected from the above table, dependent upon the magnitude and/or nature of the change in height and profile of the molded structure 90. Such selection may also be dependent upon the current state of extension of the lifting columns 16.

As previously noted one result to be achieved in association with any change in height of the offset mold 22 is that the first and second side form assemblies 70 and 72 must be extended or retracted in length to correspond to the change in height of the mold 22 so that the side plates 84 and 88 extend all the way down to or substantially down to the ground surface 20. This may be described as having the controller 110 configured such that for a given increase in the height of the mold frame 54 relative to the ground surface 20 there is an equal increase in a combined downward extension of the first form insert and first side plate relative to the mold frame, and there is an equal increase in a combined downward extension of the second form insert 78 and the second side plate 80 relative to the mold frame 54.

It will be appreciated that the offset mold 22 with its mold frame actuator 56 is constructed to provide for changes in height of the offset mold 22 relative to the ground surface which are substantially larger that any changes which could be achieved solely through the use of the actuators 32 within the lifting columns 16. On the other hand, it will be appreciated that relatively small changes in the height of the mold 22 relative to the ground surface 20 may be achieved either through use of the actuators 32 of the lifting columns 16 or through use of the mold frame actuator 56. For example, typical actuators 32 of the lifting columns 16 may be capable of moving through a leg stroke of a maximum of approximately 42 inches. The mold frame actuator 56, on the other hand, may be constructed to achieve much larger changes in elevation of the mold frame 54 relative to the machine frame 12, on the order of as much as nine feet (108 inches). It will further be appreciated that due to concerns for stability of the paving machine 10, and due to the high weight of the relatively large offset mold 22 it may be desired not to extend the actuators 32 of the lifting columns 16 to their furthest possible extension. Thus, it may be desired to only utilize the actuators 32 within a relatively small range of perhaps 24 inches.

The controller 110 may be configured to control smaller changes in height of the mold frame 54 relative to the ground surface 20 via the machine frame support actuators 32, and to control larger changes in the height of the mold frame 54 relative to the ground surface 20 via the mold frame actuator 56.

Control of the Conveyor

Figure 2A:
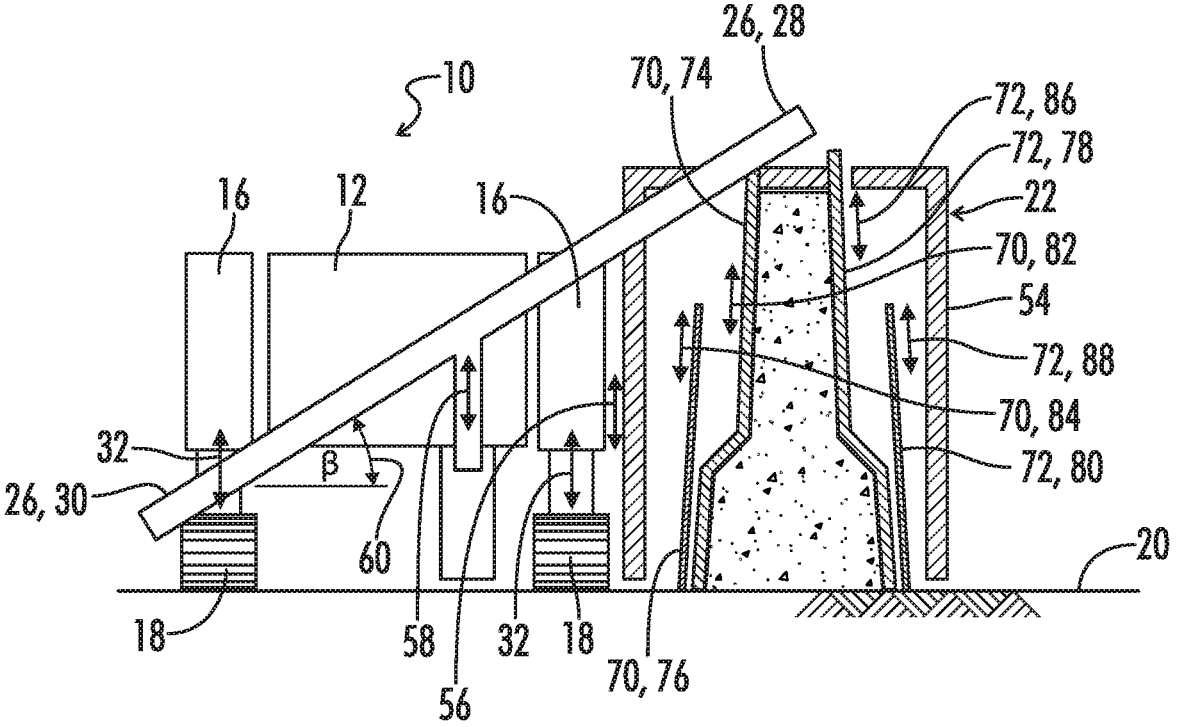
FIG. 2A is a schematic front elevation view of the paving machine of FIG. 1 in a first orientation.

For a given height of the offset mold 22 and its mold frame 54 relative to the ground surface 20 as shown for in example in FIG. 2A, the conveyor 26 will be positioned relative to the machine frame 12 so that its lower end 30 is accessible by a concrete supply truck or the like, and such that its upper end 28 is located above the mold 22 so as to discharge concrete material to be formed into a receiving inlet in the mold 22 for directing the same in between the mold form assemblies 70 and 72 to be formed into the concrete barrier wall structure 90. As previously described with regard to FIG. 3, the position of the conveyor 26 relative to the machine frame 12 is at least in part controlled by a conveyor actuator 58. Typically, the lower portion of conveyor 26 will be pivotally supported from the machine frame 12, for example at pivotal connection 57 schematically seen in FIG. 3. The conveyor 26 may also have an intermediate point pivotally connected to the conveyor actuator 58 such as at pivotal connection 59 (see FIG. 3). Thus as the machine frame 12 is changed in height relative to the ground surface by actuators 32 and/or as the mold frame 54 is changed in height relative to the machine frame 12 by mold frame actuator 56, it is necessary to reorient the conveyor 26 relative to the machine frame 12 so that its lower end 30 remains accessible by a concrete supply truck, and so that its upper end 28 remains located above the upper inlet of the mold 22. This change in orientation is typically accomplished by extension and retraction of the conveyor actuator 58 so as to change the angle 60 of the conveyor relative to the machine frame 12.

The controller 110 may be generally described as being configured to control extension of the conveyor actuator 58 at least in part as a function of at least one of the signal from the mold frame sensor 56S and the signal from at least one of the machine frame support sensors 32S.

EXAMPLES OF FIGS. 2A-2F

FIGS. 2A-2F schematically show several examples of the modes of control that can be accomplished with the machine 10. In FIG. 2A the mold frame 54 is at a relatively low position relative to the ground and the machine frame 12.

Figure 2B:
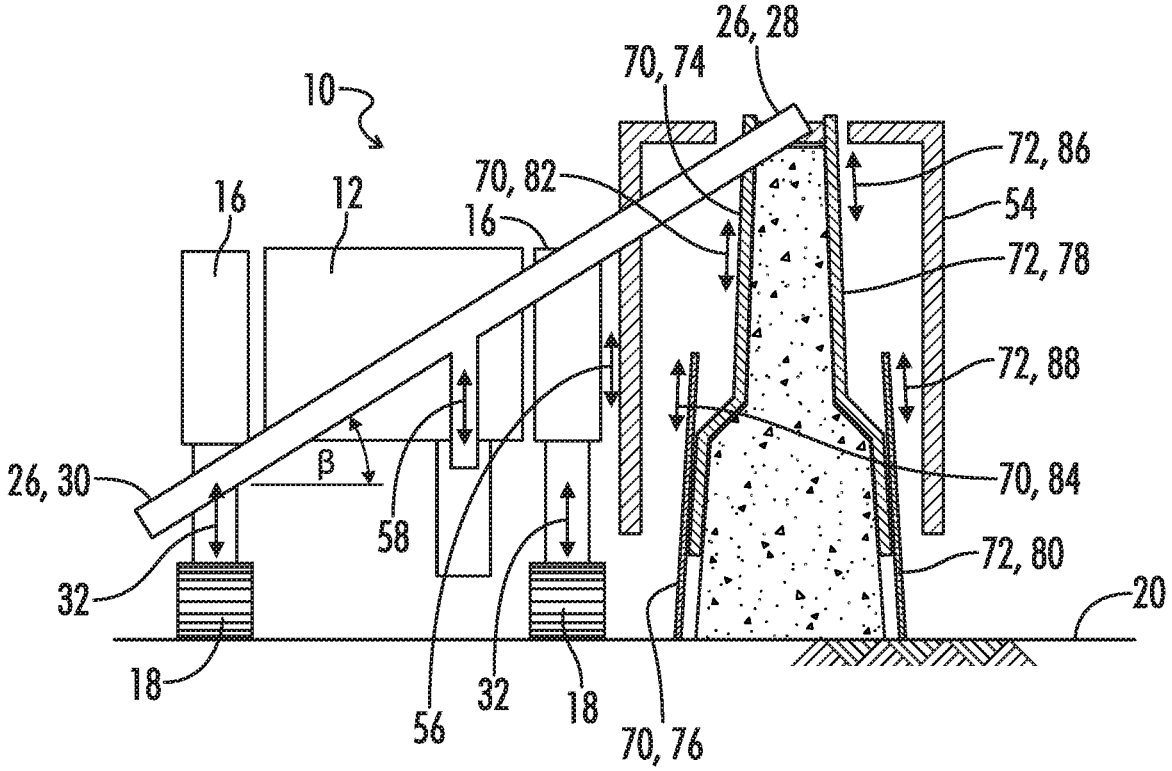
FIG. 2B is a schematic front elevation view of the paving machine of FIG. 2A in a second orientation.

In FIG. 2B, as compared to FIG. 2A, the lifting column actuators 32 have been extended thus raising the machine frame 12 and the attached conveyor 26 and mold frame 54. The side plates 76 and 80 have been extended downward relative to the side form inserts 74 and 78, to keep the lower edges of the side plates near the ground surface 20. Note that these changes have resulted in a change in the height 92 of the molded structure 90 as identified in FIG. 6.

Figure 2C:
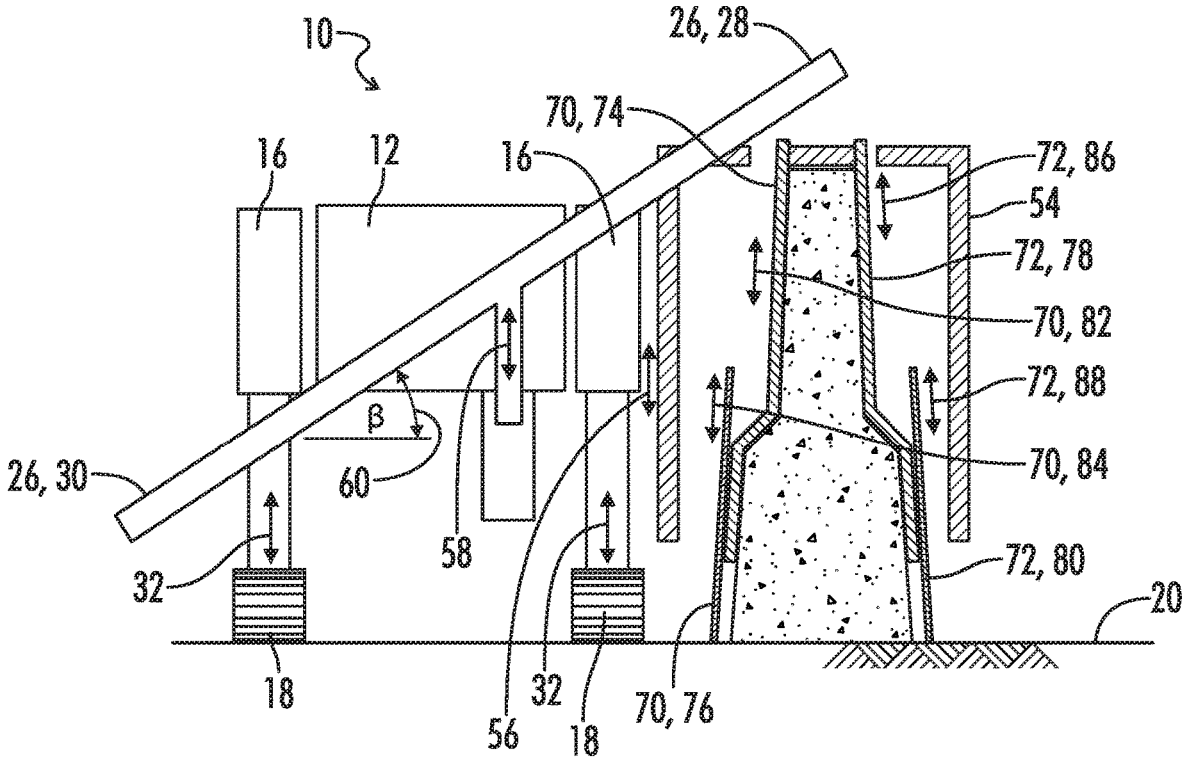
FIG. 2C is a schematic front elevation view of the paving of machine of FIG. 2A in a third orientation.

In FIG. 2C, as compared to FIG. 2B, the lifting column actuators 32 are still further extended. The mold actuator 56 has lowered the mold frame 54 relative to the machine frame 12.

Figure 2D:
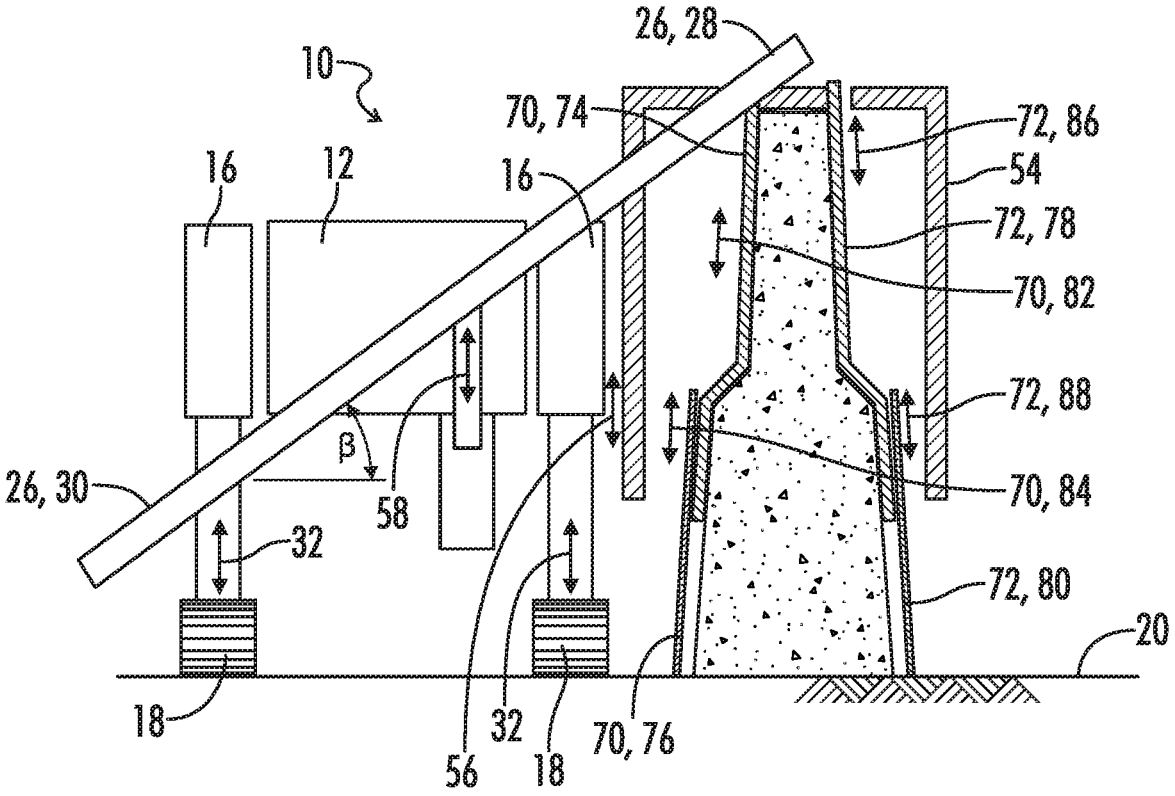
FIG. 2D is a schematic front elevation view of the paving of machine of FIG. 2A in a forth orientation.

In FIG. 2D, as compared to FIG. 2C, the mold actuator 56 has lifted the mold frame 54 relative to the machine frame 12. The side plates 76 and 80 have been further extended downward relative to the side form inserts 74 and 78 using actuators 84 and 88, to keep the lower edges of the side plates near the ground surface 20.

Figure 2E:
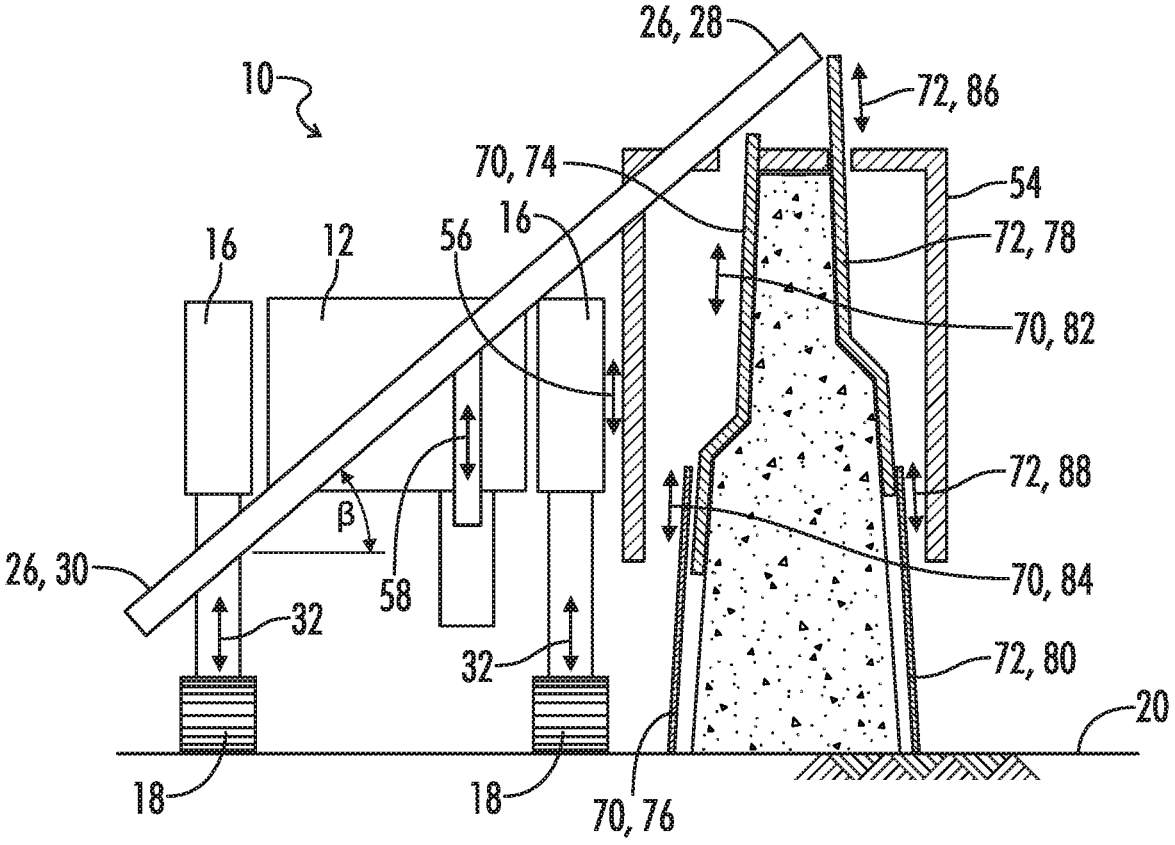
FIG. 2E is a schematic front elevation view of the paving of machine of FIG. 2A in a fifth orientation.

In FIG. 2E, as compared to FIG. 2D, the second insert form 78 has been raised relative to the mold frame 54 using actuator 86, the second side plate 80 has been further extended relative to second insert form 78 using actuator 88, and the conveyor 26 has been raised using conveyor actuator 58. Note that these changes have resulted a change in the right side profile 96 of the molded structure 90, without changing the height 92 of the molded structure 90.

Figure 2F:
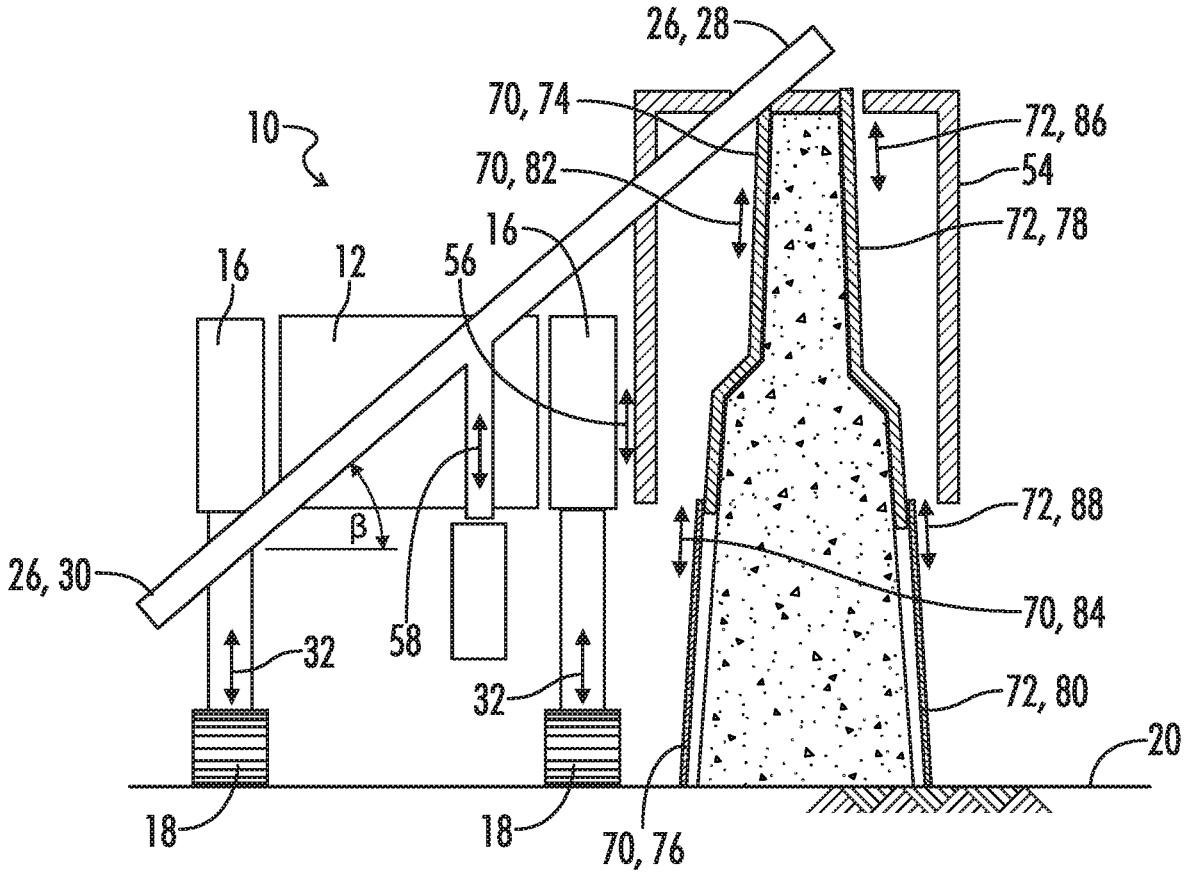
FIG. 2F is a schematic front elevation view of the paving of machine of FIG. 2A in a sixth orientation.

In FIG. 2F, as compared to FIG. 2E, the mold frame 54 has been further raised relative to machine frame 12 using mold actuator 56, the second form insert 78 has been lowered relative to mold frame 54 using actuator 86, the first side plate 76 has been lowered relative to the first form insert 74 using actuator 84, and the machine frame 12 has been further raised relative to the tracks 16 using the lifting column actuators 32.

External Reference Systems

One form of external reference system which has previously been noted is the use of a stringline 62 which has been constructed on the ground surface 20 adjacent the path of the desired slipform concrete structure 90. For such an external reference system, the external reference sensor 60 may include a stringline sensor as schematically illustrated in FIG. 3. With such a system the controller 110 may be described as being configured to control extension of the machine frame support actuators 32 and the mold frame actuator 56 to control the height of the mold frame 54 relative to the ground surface 20 at least in part in response to the signal from the string line sensor 60.

In connection with the use of a stringline the paving machine 10 may use a cross slope control to control the elevation of the opposite side of the machine from the stringline.

When using the stringline type of external reference system, the stringline 62 may convey the information about the desired overall height 92 of the molded structure 90. Information for the control of the position of the steps 98 and 100 formed by the form inserts 74 and 78 may be communicated to the controller 110 in various ways. One technique is to utilize a second stringline (not shown) constructed alongside the path of the barrier wall 90 which second stringline is used to communicate information regarding the desired position of one or both of the form inserts 76 and 78.

One alternative form of external reference system is the use of a three-dimensional guidance system. As will be appreciated by those skilled in the art such a three-dimensional guidance system may include one or more GPS sensors mounted on or fixed relative to the machine frame 12 or the mold frame 54 and receiving signals from a global navigation satellite system (GNSS) via which the position of the sensors within the three-dimensional reference system may be established. With such a system the external reference sensor may be described as being part of a three-dimensional guidance system and the controller 110 may be described as being configured to control extension of the machine frame support actuators 32 and the mold frame actuator 56 to control the height of the mold frame 54 relative to the ground surface 20 at least in part in response to the signals from the external reference sensors.

Another alternative form of external reference system is the use of a total station, which is another type of three-dimensional guidance system. The total station may be placed on the ground at a known location within the external reference system, and one or more reflector prisms may be mounted on the slipform paving machine. The total station measures the distance and direction to the reflectors and thus determines the position and orientation of the slipform paving machine within the external reference system. The total station may transmit a signal to the controller of the slipform paving machine, the signal being representative of the position of the slipform paving machine relative to the external reference system. The reflector prisms, in association with the total station, may be considered to be external reference sensors configured to provide a signal representative of a position of the slipform paving machine relative to the external reference system.

With any of the external reference systems described herein, the external reference sensor or sensors may be mounted on the mold frame 54, or on the machine frame 12, or elsewhere on the slipform paving machine 10. What is important is that the position of the mold frame 54 relative to the positions of the external reference sensor or sensors is known or can be determined from the geometry of the slipform paving machine 10 and the known positions of the various actuators. Regardless of the location of the external reference sensor or sensors, the external reference sensor or sensors may be described as being configured to provide a signal representative of a position of the slipform paving machine relative to the external reference system.

In combination with the input signals from either the stringline or the three-dimensional guidance system, or the total station, the controller 110 may utilize pre-programed instructions (for example via the software 124) to determine the desired overall height of the structure 90 and the desired side profiles 94 and 96 of the slipform structure 90 at various locations along the path of the paving machine 10.

Methods of Operation

When constructing a molded barrier wall 90 with the slipform paving machine 10 described above, the controller 110 will perform steps of receiving in the controller 110 a signal from the external reference sensor 60 and then controlling the extension of the machine frame support actuators 32 and the mold frame actuator 56 to control the height of the mold frame 54 relative to the ground surface 20.

In further response to changes in the height of the mold frame 54 relative to the ground surface 20, the controller 110 may control extension of the conveyor actuator 58 to reorient the conveyor 26 to keep its upper end 28 appropriately situated above the material inlet in the upper end of the mold 22.

Also, concurrently with changing the height of the mold frame 54 relative to the ground surface 20, the controller 110 may control the various actuators 82, 84, 86, and 88 associated with the first and second side form assemblies 70 and 72 so that the extension of the side form assemblies 70 and 72 corresponds to changes to height of the mold frame 54 so that the side form assemblies still extend down substantially to the ground surface 20.

Furthermore, the controller 110 may control the various actuators 82, 84, 86, and 88 to situate the form inserts 74 and 78 at appropriate elevations relative to the ground 20 to form the steps 98 and 100 of the slipformed concrete structure 90 at the appropriate elevations as desired by the construction plan.

Thus, it is seen that the apparatus and methods of the present invention readily achieve the ends and advantages mentioned as well as those inherent therein. While certain preferred embodiments of the present invention have been illustrated and described for purposes of the present disclosure, numerous changes in the arrangement and construction of parts and steps may be made by those skilled in the art which changes are encompassed within the scope and spirit of the present invention as defined by the appended claims.

What is claimed is:

1. A slipform paving machine, comprising:

a machine frame;

a plurality of ground engaging units for supporting the slipform paving machine from a ground surface;

a plurality of height adjustable machine frame supports supporting the machine frame from the plurality of ground engaging units, each of the machine frame supports including a machine frame support actuator configured to adjust a height of the machine frame relative to a respective one of the ground engaging units, and each of the machine frame supports including a machine frame support sensor configured to provide a signal corresponding to the height of the machine frame relative to the respective one of the ground engaging units;

an offset mold including a mold frame;

a mold frame actuator configured to adjust a height of the mold frame relative to the machine frame during a paving operation;

a mold frame sensor configured to provide a signal corresponding to the height of the mold frame relative to the machine frame;

an external reference sensor configured to provide a signal representative of a position of the slipform paving machine relative to an external reference system; and a controller configured to:

receive the signal from the external reference sensor; and control extension of the machine frame support actuators and the mold frame actuator during the paving operation to control a height of the mold frame relative to the ground surface.

2. The slipform paving machine of claim 1, further comprising:

a conveyor arranged to discharge material to be molded into the mold;

a conveyor actuator configured to adjust a position of the conveyor relative to the machine frame; and a conveyor sensor configured to provide a signal corresponding to the position of the conveyor relative to the machine frame.

3. The slipform paving machine of claim 2, wherein:

the controller is further configured to control extension of the conveyor actuator at least in part as a function of at least one of the signal from the mold frame sensor and the signal from at least one of the machine frame support sensors.

4. The slipform paving machine of claim 1, wherein:

the external reference sensor includes a stringline sensor; and the controller is configured to control extension of the machine frame support actuators and the mold frame actuator to control the height of the mold frame relative to the ground surface at least in part in response to a signal from the stringline sensor.

5. The slipform paving machine of claim 1, wherein:

the external reference sensor is part of a three-dimensional guidance system; and the controller is configured to control extension of the machine frame support actuators and the mold frame actuator to control the height of the mold frame relative to the ground surface at least in part in response to the signal from the external reference sensor.

6. The slipform paving machine of claim 1, wherein:

the height adjustable machine frame supports are lifting columns, the machine frame support actuators include hydraulic piston-cylinder units located within their respective lifting columns, and the machine frame support sensors are integrated in their respective hydraulic piston-cylinder units; and the mold frame actuator includes a hydraulic piston-cylinder unit, and the mold frame sensor is integrated in the hydraulic piston-cylinder unit of the mold frame actuator.

7. The slipform paving machine of claim 1, wherein:

the controller is configured to control smaller changes in the height of the mold frame relative to the ground surface via the machine frame support actuators, and to control larger changes in the height of the mold frame relative to the ground surface via the mold frame actuator.

8. The slipform paving machine of claim 1, wherein the mold further comprises:

a first side form assembly including:

a first form insert;

a first form insert actuator configured to adjust the height of the first form insert relative to the mold frame;

a first form insert sensor configured to provide a signal corresponding to the height of the first form insert relative to the mold frame;

a first side plate; and a first side plate actuator configured to adjust a height of the first side plate; and a second side form assembly including:

a second form insert;

a second form insert actuator configured to adjust the height of the second form insert relative to the mold frame;

a second form insert sensor configured to provide a signal corresponding to the height of the second form insert relative to the mold frame;

a second side plate; and a second side plate actuator configured to adjust a height of the second side plate.

9. The slipform paving machine of claim 8, further comprising:

a first side plate sensor configured to provide a signal corresponding to the height of the first side plate; and a second side plate sensor configured to provide a signal corresponding to the height of the second side plate.

10. The slipform paving machine of claim 8, wherein:

the controller is further configured to control a change in position of at least one of the first form insert actuator and the first side plate actuator, and to control a change in position of at least one of the second form insert actuator and the second side plate actuator, in response to a change in the height of the mold frame relative to the ground surface.

11. The slipform paving machine of claim 10, wherein:

the controller is configured to provide for a mode of operation wherein for a given change in height of the mold frame relative to the ground surface, on each of the first side form assembly and the second side form assembly the respective form insert actuator provides a corresponding change in position while the respective side plate actuator remains fixed.

12. The slipform paving machine of claim 10, wherein:

the controller is configured to provide for a mode of operation wherein for a given change in height of the mold frame relative to the ground surface, on one of the first side form assembly and the second side form assembly the respective form insert actuator position is fixed and the respective side plate actuator provides a corresponding change in position, and on the other of the first side form assembly and the second side form assembly the respective form insert actuator provides a corresponding change in position while the respective side plate actuator remains fixed.

13. The slipform paving machine of claim 10, wherein:

the controller is configured to provide for a mode of operation wherein for a given change in height of the mold frame relative to the ground surface, on each of the first side form assembly and the second side form assembly the respective form insert actuator position is fixed and the respective side plate actuator provides a corresponding change in position.

14. The slipform paving machine of claim 10, wherein:

the controller is further configured such that for a given increase in the height of the mold frame relative to the ground surface there is an equal increase in a combined downward extension of the first form insert and first side plate relative to the mold frame, and there is an equal increase in a combined downward extension of the second form insert and second side plate relative to the mold frame.

15. The slipform paving machine of claim 10, wherein:

each of the first form insert actuator and the second form insert actuator includes a hydraulic piston-cylinder unit; and each of the first form insert sensor and the second form insert sensor is integrated in the hydraulic piston-cylinder unit of its respective actuator.

16. The slipform paving machine of claim 10, wherein:

the first side plate actuator is configured to adjust a height of the first side plate relative to the first form insert; and the second side plate actuator is configured to adjust a height of the first side plate relative to the second form insert.

17. A method of operating a slipform paving machine, the machine including:

a machine frame;

a plurality of ground engaging units supporting the slipform paving machine from a ground surface;

a plurality of height adjustable machine frame supports supporting the machine frame from the plurality of ground engaging units, each of the machine frame supports including a machine frame support actuator configured to adjust a height of the machine frame relative to a respective one of the ground engaging units, and each of the machine frame supports including a machine frame support sensor configured to provide a signal corresponding to the height of the machine frame relative to the respective one of the ground engaging units;

an offset mold including a mold frame;

a mold frame actuator configured to adjust a height of the mold frame relative to the machine frame;

a mold frame sensor configured to provide a signal corresponding to the height of the mold frame relative to the machine frame;

an external reference sensor configured to provide a signal representative of a position of the slipform paving machine relative to an external reference system; and a controller;

the method comprising steps of:

(a) receiving in the controller the signal from the external reference sensor; and (b) controlling with the controller extension of the machine frame support actuators and the mold frame actuator during a paving operation to control a height of the mold frame relative to the ground surface.

18. The method of claim 17, wherein the machine further includes:

a conveyor arranged to discharge material to be molded into the mold;

a conveyor actuator configured to adjust a position of the conveyor relative to the machine frame; and a conveyor sensor configured to provide a signal corresponding to the position of the conveyor relative to the machine frame; and the method further comprising:

controlling with the controller extension of the conveyor actuator in response to changes in height of the mold frame relative to the ground surface, to maintain an upper end of the conveyor above an inlet of the mold.

19. The method of claim 17, wherein the machine further includes:

a first side form assembly including:

a first form insert;

a first form insert actuator configured to adjust the height of the first form insert relative to the mold frame;

a first form insert sensor configured to provide a signal corresponding to the height of the first form insert relative to the mold frame;

a first side plate; and a first side plate actuator configured to adjust a height of the first side plate; and a second side form assembly including:

a second form insert;

a second form insert actuator configured to adjust the height of the second form insert relative to the mold frame;

a second form insert sensor configured to provide a signal corresponding to the height of the second form insert relative to the mold frame;

a second side plate; and a second side plate actuator configured to adjust a height of the second side plate;

the method further comprising:

controlling with the controller one or more of the actuators of each of the first and second side form assemblies so that extension of the side form assemblies corresponds to changes in height of the mold frame.

20. The method of claim 19, wherein the machine further includes:

a first side plate sensor configured to provide a signal corresponding to the height of the first side plate; and a second side plate sensor configured to provide a signal corresponding to the height of the second side plate.

* * * * *